US008690398B2

(12) United States Patent
Restel

(10) Patent No.: US 8,690,398 B2
(45) Date of Patent: Apr. 8, 2014

(54) VERTICALLY ADJUSTABLE CUBICLE LAMP

(75) Inventor: Carrie Ann Restel, Shreveport, LA (US)

(73) Assignee: Evolution Lighting, LLC, Miami Lakes, FL (US)

( * ) Notice: Subject to any disclaimer, the term of this patent is extended or adjusted under 35 U.S.C. 154(b) by 0 days.

(21) Appl. No.: 13/467,192

(22) Filed: May 9, 2012

(65) Prior Publication Data

US 2013/0003371 A1 Jan. 3, 2013

Related U.S. Application Data

(60) Provisional application No. 61/484,831, filed on May 11, 2011.

(51) Int. Cl.

| | |
|---|---|
| ***F21S 8/08*** | (2006.01) |
| ***F21V 21/08*** | (2006.01) |
| ***F21V 21/00*** | (2006.01) |
| ***F21V 21/088*** | (2006.01) |

(52) U.S. Cl.

CPC ..... *F21V 21/088* (2013.01)
USPC ..... 362/418; 362/396; 362/285; 362/152

(58) Field of Classification Search

USPC ..... 362/396, 418, 422–424, 147–150, 648, 362/33, 432, 382, 285

See application file for complete search history.

(56) References Cited

U.S. PATENT DOCUMENTS

| | | | | |
|---|---|---|---|---|
| 2,736,229 | A * | 2/1956 | Huebner | 355/37 |
| 3,288,406 | A * | 11/1966 | Degen | 248/49 |
| 4,712,167 | A * | 12/1987 | Gordin et al. | 362/233 |
| 5,101,332 | A * | 3/1992 | Hsia | 362/401 |
| 5,440,469 | A * | 8/1995 | Gomes | 362/648 |
| 5,637,964 | A * | 6/1997 | Hakkarainen et al. | 315/295 |
| 6,502,957 | B1 * | 1/2003 | Klaitman | 362/249.01 |
| 7,290,742 | B2 * | 11/2007 | Wang | 248/200.1 |
| 8,408,733 | B2 * | 4/2013 | Nelson et al. | 362/197 |
| 2006/0077672 | A1 * | 4/2006 | Schaak | 362/418 |
| 2009/0116230 | A1 * | 5/2009 | Young | 362/198 |

* cited by examiner

*Primary Examiner* — Diane Lee
*Assistant Examiner* — Kenny C Sokolowski
(74) *Attorney, Agent, or Firm* — Feldman Gale, P.A.; Michael C. Cesarano

(57) ABSTRACT

A vertically adjustable cubicle lamp may be suspended on two vertical rods configured to grip the upper edge of a cubicle wall. The lamp may be vertically positioned and secured through a frictional fit, a mechanical interface, or a wirelessly controlled traction motor. Lamp intensity may be controlled through a microprocessor.

1 Claim, 10 Drawing Sheets

VERTICALLY ADJUSTABLE CUBICLE LAMP

CROSS REFERENCE TO RELATED APPLICATIONS

This application claims the benefit of 35 USC 119(e) to U.S. Provisional Application No. 61/484,831, filed May 11, 2011. The disclosure of which is hereby incorporated herein by reference in its entirety

BACKGROUND OF THE INVENTION

The lighting for an office cubicle is generally provided through an overhead ceiling fixture or by way of a table lamp on a desk. In working environments in which overhead lighting may be less than optimal, such as when a fluorescent tube or supporting apparatus fails, or in the situation in which a worker suffers fatigue or headaches resulting from the 60 cycle per second flicker of such lighting, a common alternative is to have an incandescent desk lamp taking up space on a desk. While there are lamps that can be attached to a cubicle wall with a spring clamp or similar fastener, they tend to be situated at the approximate height of the cubicle wall, and may be utilitarian in appearance and operation. What is needed is a lamp that can be attached to a cubicle wall, and that is variable in height such that it may be adjusted to prevent the light from shining in a cubicle worker's eyes, or may be adjusted to an optimum height to provide sufficient light for reading or working, depending upon the individual preferences of the user.

SUMMARY OF THE INVENTION

The invention is a cubicle lighting fixture that mounts to the upper edge of a cubicle wall and is vertically adjustable on a frame that hangs vertically downward into the cubicle working area. The frame is a squared-off "U"-shaped rod that forms two vertical supports attached to a bracket that is supported by an upper edge of a cubicle wall. A base component is mounted on the frame and may be adjusted along the vertical supporting rods. In one embodiment, the lamp has dual lamp heads that may be individually adjusted to focus light in a desired direction. In alternative embodiments, any number of lamp heads from a single lamp head up to three or more lamp heads, may be used. Persons of ordinary skill in the art will understand that any desired lamp head may be used on the single or multiple gooseneck cubicle lamp of this invention without departing from the scope of the invention. The light bulbs in the multiple lamp embodiment may be individually actuated, or may be actuated together. Various mechanisms are available to provide static frictional forces or interacting mechanical latches to hold the slidable base at a given position along the vertical frame, including but not limited to tightening screws, frictional engagement of a cylindrical wrapping around the vertical support rods of the frame, placing horizontal stress upon the vertical rods to cause them to provide friction through spring action where they contact the base unit, notches or other roughened surface of the rods to provide a frictional surface to retard movement of the base, or clamping mechanisms. The frame is supported by the upper edge of the cubicle wall, and is attached thereto with a bracket that may be adjustable with tightening screws, a spring, or by interconnecting "L" shaped bracket components that may be adjusted to a desired width to receive the cubicle wall's upper edge.

The cubicle lamp of this invention may be operated by a switch integral to a power cord, or by a switch situated within the base. If desired, a controller may be used to control the intensity of each lamp attached to the base, and the intensity of each lamp may be individually controlled between positions of "off," "full on," and any intensity level between those extremes. In one embodiment, a wireless remote controller may be used to send wireless signals to the controller in the base to control the intensity of each lamp. In another embodiment, a small traction motor connected to a roller may be placed within the base, with the roller forming a frictional contact with one or more of the vertical rods. Using electrical power used to power the lamp, the traction motor may cause the roller to rotate against the rod, with resultant movement of the base upward or downward on the rod. For installations in which the cubicle lamp is not easily accessible, such as, for example, where a large desk is between a person and the lamp, a wireless remote controller may operate the traction motor to adjust the vertical height of the lamp on its frame.

DESCRIPTION OF THE PREFERRED EMBODIMENTS

Figure 1:
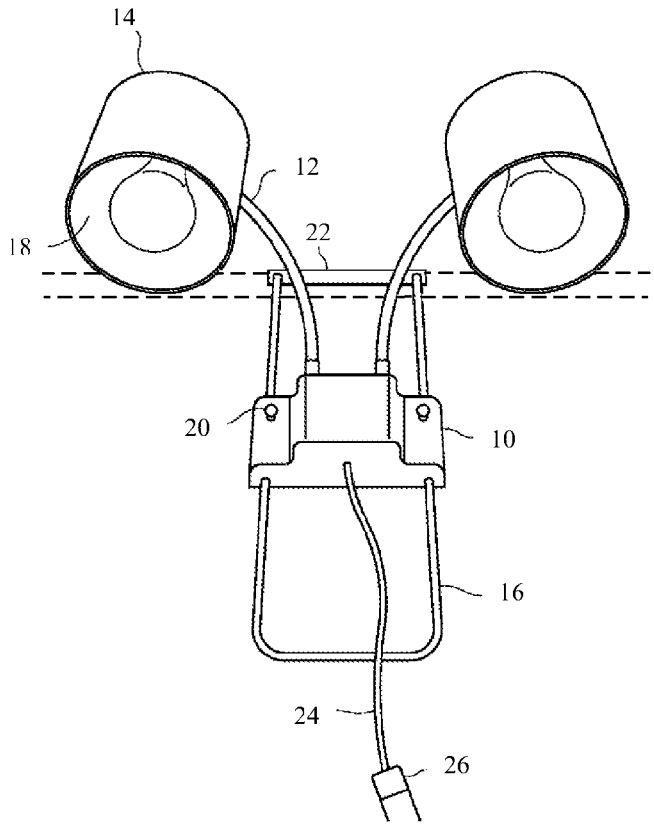
FIG. 1 is a lower perspective view of a first embodiment of a dual lamp mounted on a cubicle wall.
Figure 2:
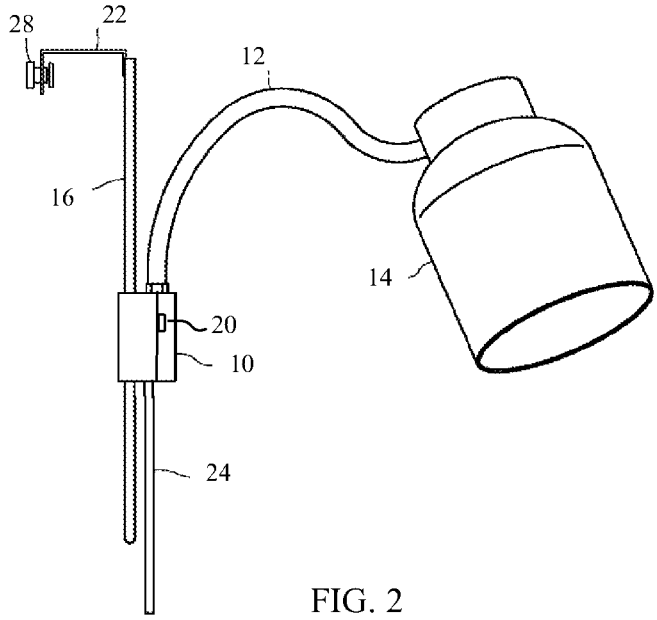
FIG. 2 is a side view of the lamp of FIG. 1.
Figure 3:
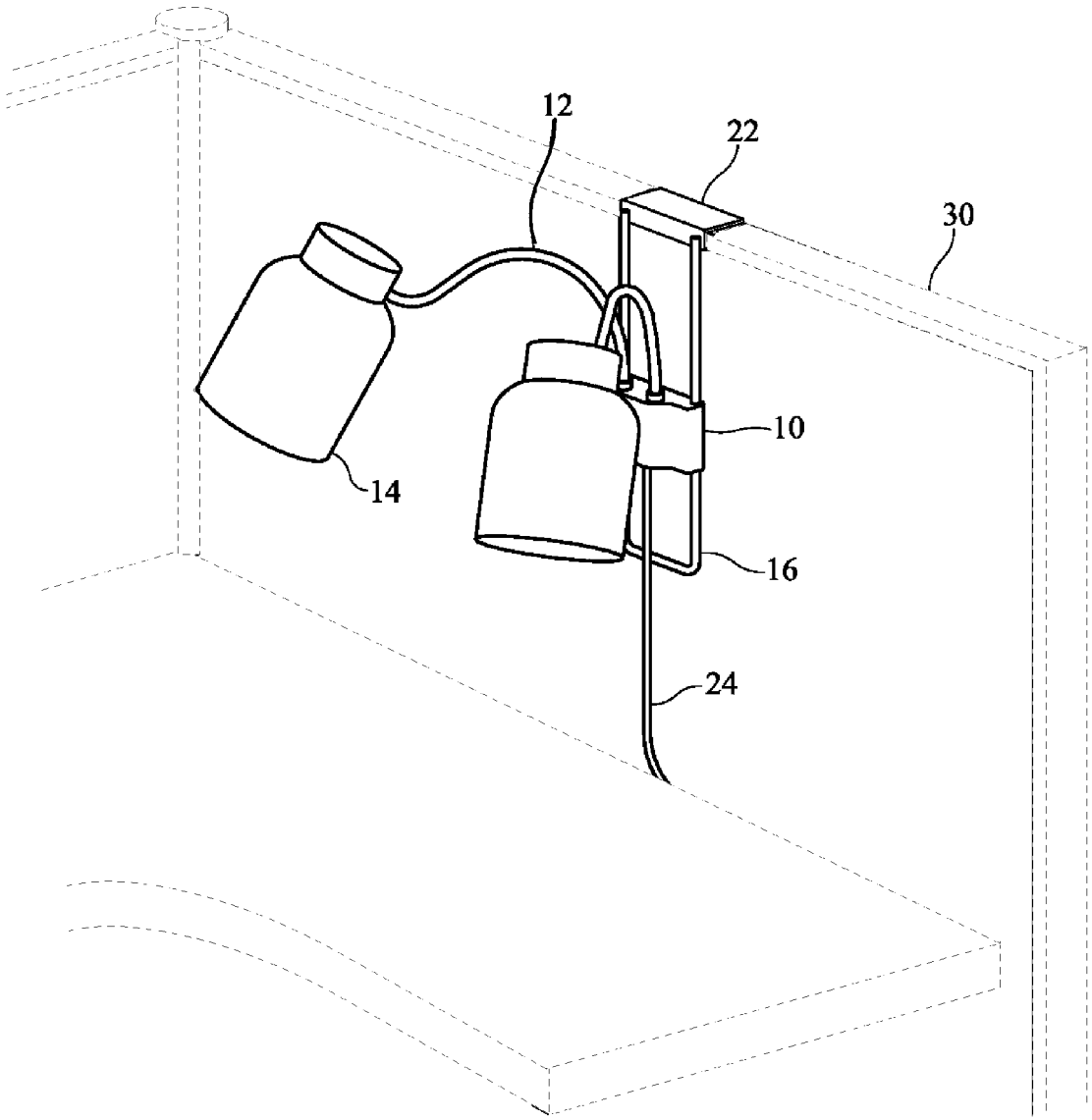
FIG. 3 is an upper perspective view of the lamp of FIG. 1 mounted on a cubicle wall.

As depicted in FIGS. 1-3, one embodiment of this invention is a cubicle lamp that has two flexible gooseneck stalks 12 attached to a base 10. Each gooseneck stalk is attached to a lamp head 14 inside of which is a light bulb 18. The base 10 is movably supported on a frame 16, and when positioned on the wall of a cubicle, is vertically adjustable along the frame. The lamp heads 14 may be actuated together or independently, and a cord 24 extends from the base 10. An actuation switch 26 may be incorporated along the cord, or can be fully contained within the base or lamp head, with only an actuation knob, lever, or pull chain protruding through or extending from the base. The lamp heads may be of any shape or configuration as long as they house a light bulb or other lighting component.

The frame consists of two vertically oriented supports which may be rods 16 connected at their lower ends to form a squared-off "U" shape. The "U" portion of the frame may be of single piece or multiple piece construction. The upper ends of the rods are affixed to a bracket 22 that is adaptable to fit over the uppermost edge of a cubicle wall. The bracket may include a tightening and adjustment mechanism 28 suitable to attach the bracket to cubicle walls of different thicknesses. The base 10 has two vertical elongated tunnels, or holes 36, that extend completely through the base 10, and that receive the rods 16 of the frame. The base 10 is slidable along the rods of the frame 16, and is prevented from sliding off the lower end by the squared "U" shape of the rods at the lower end of the frame. At the upper end of the frame, the rods are affixed to the bracket 22. The base 10 can be held in place in any position on the frame in a variety of ways. In an embodiment depicted in FIG. 1, the base may be secured against movement along the frame by means of tightening screws 20 that extend through threaded holes in the base 10 and are tightened against the rods of the frame to create a frictional attachment. The threaded holes may be on the front side of the base, that is, the side opposite a cubicle wall 30 when the lamp is mounted in a position for normal use, or, in an alternative embodiment, the threaded holds may be on the back side of the base. The tightening screws 20 may have circular or polygonal heads with striations suitable for finger tightening, or they may be adapted to receive a tool such as a screwdriver, allen wrench, or the like.

The bracket 22 to which rods 16 are affixed, is adjustable to fit over an upper edge of a cubicle wall and to be secured thereto. In one embodiment, the bracket is in the shape of an inverted "U" and is wide enough to receive the upper edge of the thickest cubicle wall suitable for the lamp. In FIG. 2, one or more adjustment screws 28 are depicted that may be used to tighten the bracket 22 against the wall support. Although the one or more adjustment screws 28 will normally be applied against the outer side of the cubicle wall 30, circumstances may require that such an attachment is impossible or impracticable, and the adjustment screws may be applied from the inside edge of the bracket with good results. In other embodiments, bracket 22 may be adjusted by enlarging or narrowing the space between the sides of the inverted "U" bracket. This may be done by creating the bracket from two pieces that slidably engage, or that have one or more common slots through which tightening screws may be inserted. Other embodiments for the bracket include an internal adjustment mechanism that may be spring loaded or that may be tensioned using threaded screws.

Figure 4:
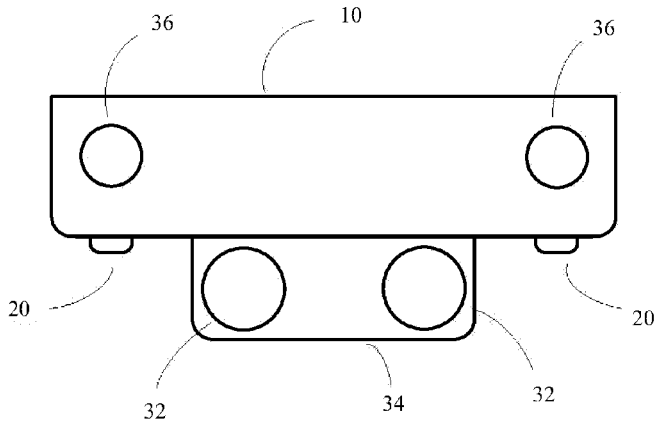
FIG. 4 is a plan view of the base of a two head lamp without frame, gooseneck, or lamp heads.
Figure 4A:
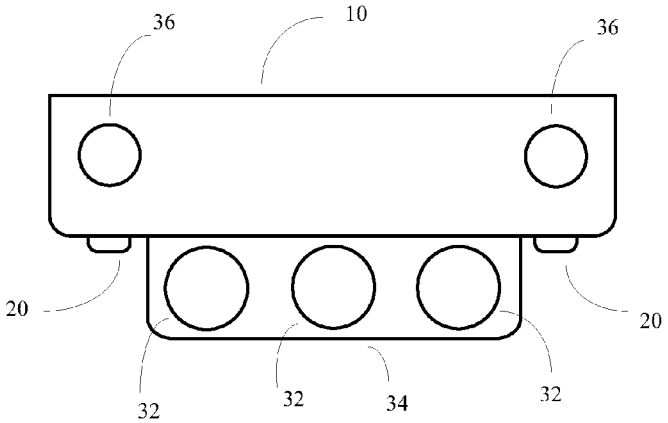
FIG. 4*a* is a plan view of the base of a three head lamp without frame, gooseneck, or lamp heads.

FIG. 4 is a plan view of the base 10 of the dual lamp embodiment of this invention. Tunnel holes 36 extend vertically through the base 10 to receive vertical rods of the frame 16 along which the base can slide. Front section 34 provides sufficient volume to house wiring and any other electrical components that may be desired for the lighting configuration. Goosenecks (not shown) attach to the base at lamp holes 32, and support the lamp heads (not shown). Threaded screws 20 may be used to tighten base 10 against the frame. FIG. 4*a* is an embodiment in which the base is configured for three lamps to be attached. The invention is capable of providing any number of lamps, and the limiting feature would be the size of the base to which lamp goosenecks and lamp heads would be attached.

Figure 5:
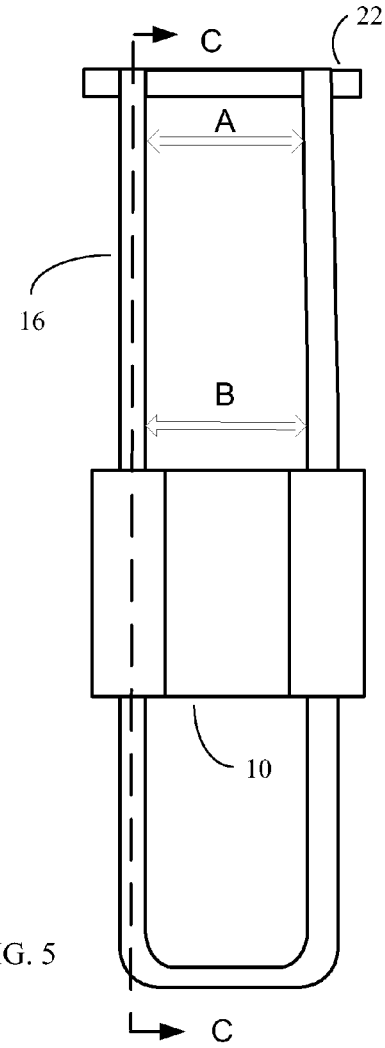
FIG. 5 is a front view of the base and frame of an embodiment without thumb screws.

In an embodiment shown in FIG. 5, the frame may be constructed of rods 16 that are slightly flexible such that, when base 10 is mounted to the frame, rods 16 are bent slightly inwardly or outwardly, and a frictional force is created between the rods 16 and the base 10. In FIG. 5, the distance between the rods 16 near bracket 22 is shown by of arrow A. Lower on the frame, arrow B may be slightly longer than Arrow A, representing a slight outward bow of frame rods 16 caused by base holes 36 being slightly farther apart than the unsprung rods. In this embodiment, the natural tendency of the rods to spring back to their original shape provides a constant static frictional force between the rods and the base that holds the base in position and prevents it from sliding under the influence of gravity until additional force is applied to move the base. Along the left side of FIG. 5 is sectional line C-C from which interior views shown in FIGS. 6-10 are taken.

Figure 6:
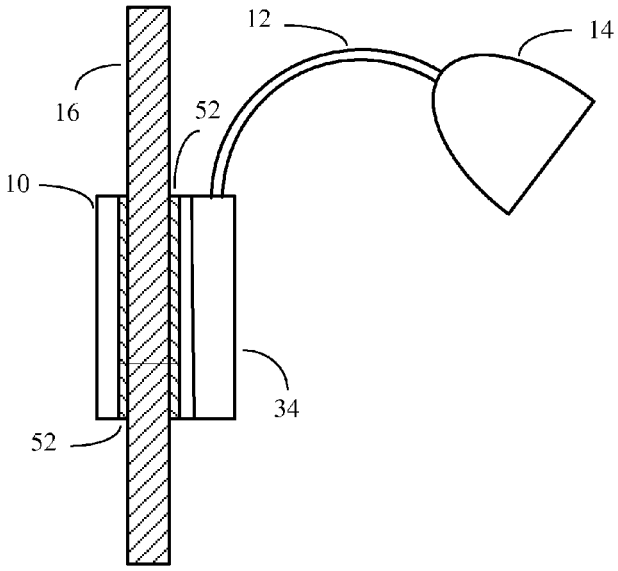
FIG. 6 is a sectional side view of an embodiment of the frame and base of the lamp with base adjustment through frictional adherence, taken along the section line C-C of FIG. 5.

For the embodiment shown in FIG. 6, the interior holes 36 extending vertically through the base, may be lined with plastic, Teflon, rubber, or some other insulating substance 52 that can be formed into a snug fit around the rods extending through the holes. In this manner, friction between the insulating material 52 and the rods 16 will be sufficient to prevent the base 10 from freely sliding along the rods, but will permit sliding when additional force is applied to produce a sliding movement.

Figure 7:
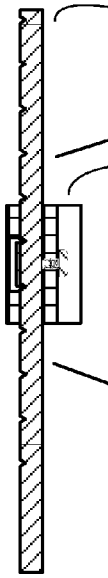
FIG. 7 is a sectional side view of the lamp base of an embodiment with base adjustment using a pawl and thumb screws, taken along the section line C-C of FIG. 5.
Figure 7A:
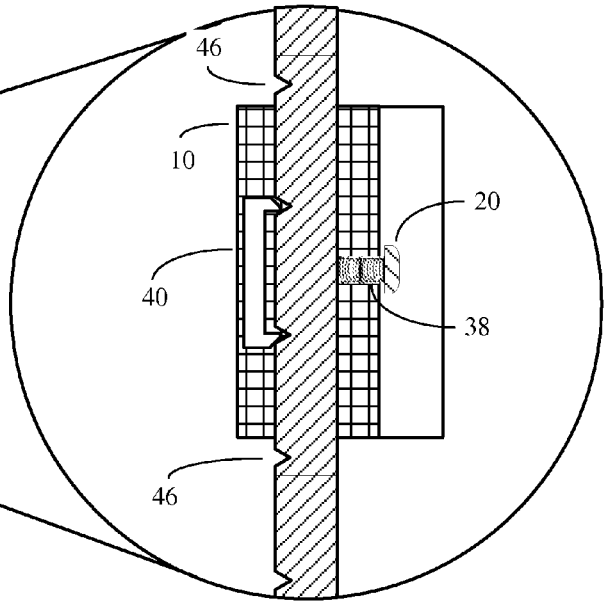
FIG. 7*a* is an enlarged view of the adjustment mechanism of FIG. 7.

In other embodiments depicted in FIGS. 7-10 and 10*a*, the rods may be provided with notches or holes such that a pawl 40 in the base can engage the notches or holes 46 to prevent the base from sliding downward on the frame. One embodiment uses notches 46 on the frame 16 together with one or more threaded screws 38 to secure the base to the frame, as shown in FIGS. 7 and 7*a*. A pawl 40 having two protrusions is held securely within the base, and engages adjacent notches 46 on vertical rods 16, and may be secured thereto by threaded screw 38. The head 20 may be large enough to be grasped between the thumb and forefinger, or may require the use of a screw driver, allen wrench, or other tool to be tightened. In some embodiments, the pawl may have a single point of engagement with the vertical rod 16. In another embodiment, a spring may be associated with the threaded screw to maintain a constant pressure against vertical rods 16, but that does not require that the threaded screw be loosened every time an adjustment in the height of the base is to be made.

Figure 8:
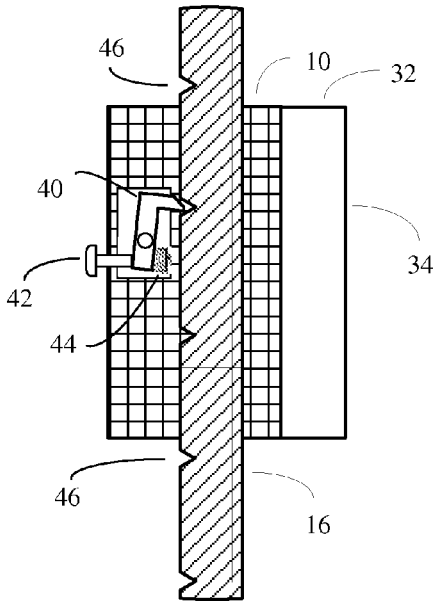
FIG. 8 is a sectional side view of an embodiment of the base and adjustment mechanism using a spring-loaded pawl taken along the section line C-C of FIG. 5.

In an embodiment depicted in FIG. 8, pawl 40 has a single protrusion, and may be spring loaded against notches 46 in rod 16. In FIG. 8, the pawl is spring loaded to exert constant pressure against the rod to ensure that it will engage any notch or hole that it may encounter. Spring 44 is situated between an interior portion of the base 10 and pawl 40, and may be released by pressing upon post 42 that extends through the rear panel of base 10. However, other configurations for spring loading the pawl against the notched rod are possible and use the same principle.

Figure 9:
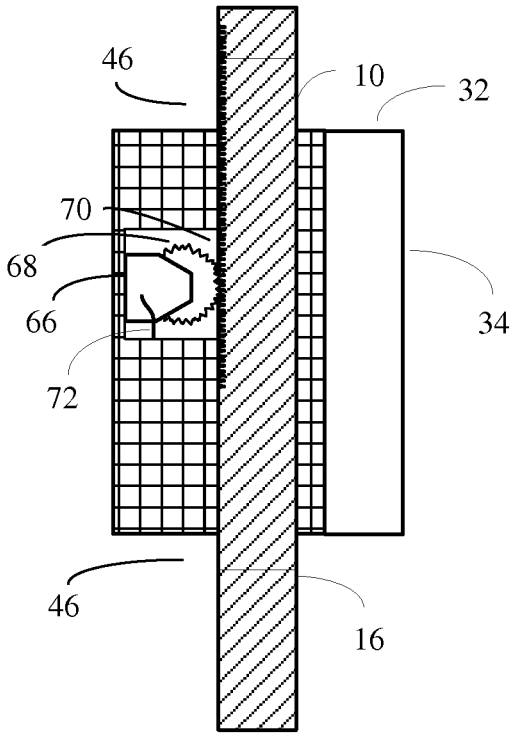
FIG. 9 is a sectional side view of an embodiment in which the vertical height is adjustable by a traction motor and roller.

FIG. 9 depicts an embodiment in which the vertical height may be adjusted by actuating a small traction motor 66 that turns a roller 68 that presses against the rod 70. The roller 68 and rod 70 may be striated to enhance the frictional contact between them and prevent slippage. The motor 66 is powered by power cord 72 which is electrically connected to power cord 24 that provides electrical power to the lamp heads.

If desired, traction motor 66 may be controlled by a processor situated within base 10 and that receives commands wirelessly from a remote control unit. In an embodiment, a processor may be configured to adjust the intensity of the lamps, either together or individually. When operated using a wireless remote control, the positioning and intensity of the lamps may be controlled from a distance, and such an embodiment may be useful where immediate access to the vertical lamp is restricted or difficult.

Figure 10:
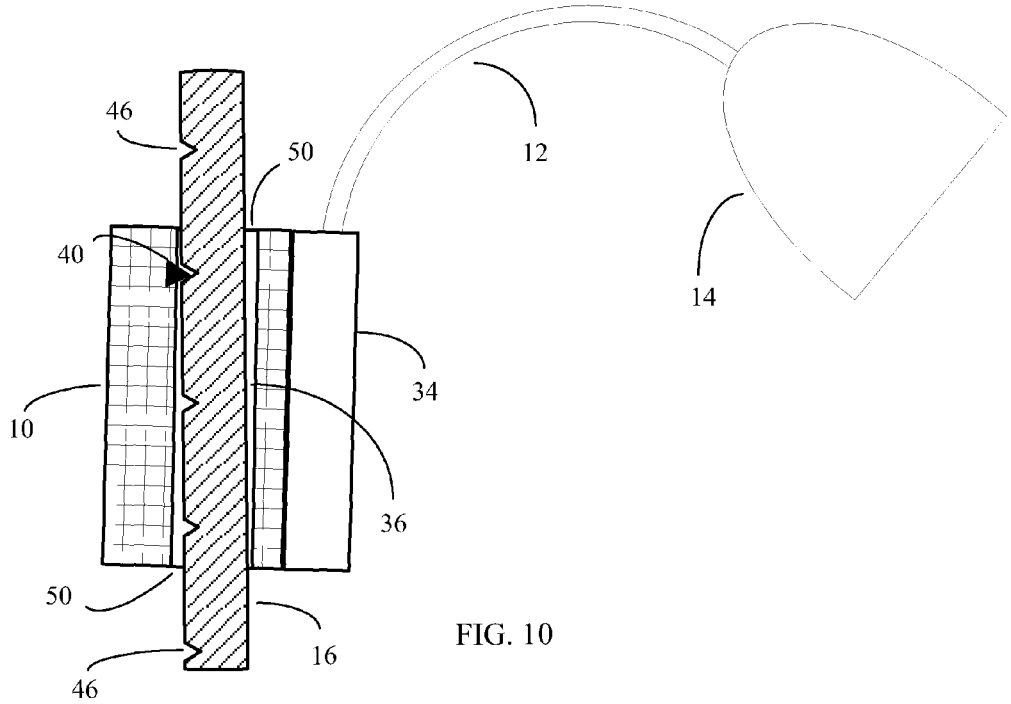
FIGS. 10 and 10*a* are sectional side views of alternative embodiments of the base adjustment mechanism lamp taken along the section line C-C of FIG. 5.

In an embodiment shown in FIG. 10, holes 36 through the base do not provide a snug fit around the rods 16, but have sufficient space or "play" 50 to allow a very slight forward tilt to the base. A pawl 40 is integral or attached to the base at the interior or either or both of holes 36. When the gravity causes the upper part of the base to tilt away from the wall, pawl 40 will engage one of the notches or holes 46 in the rod 16 to hold the base 10 against sliding movement. When it is desired to reposition the base on the vertical rods, the upper part of the base may be tilted toward the wall, pawl 40 will disengage from notch 46, and the base may then be slidably moved to another position having a notch 46 that pawl 40 can engage. Since the lamp heads 14 are affixed to the base 10 by a gooseneck 12, and extend away from the cubicle wall, they provide the base 10 with a rotational moment that causes pawl 40 to engage notch 46 to restrict further vertical movement.

Figure 10A:
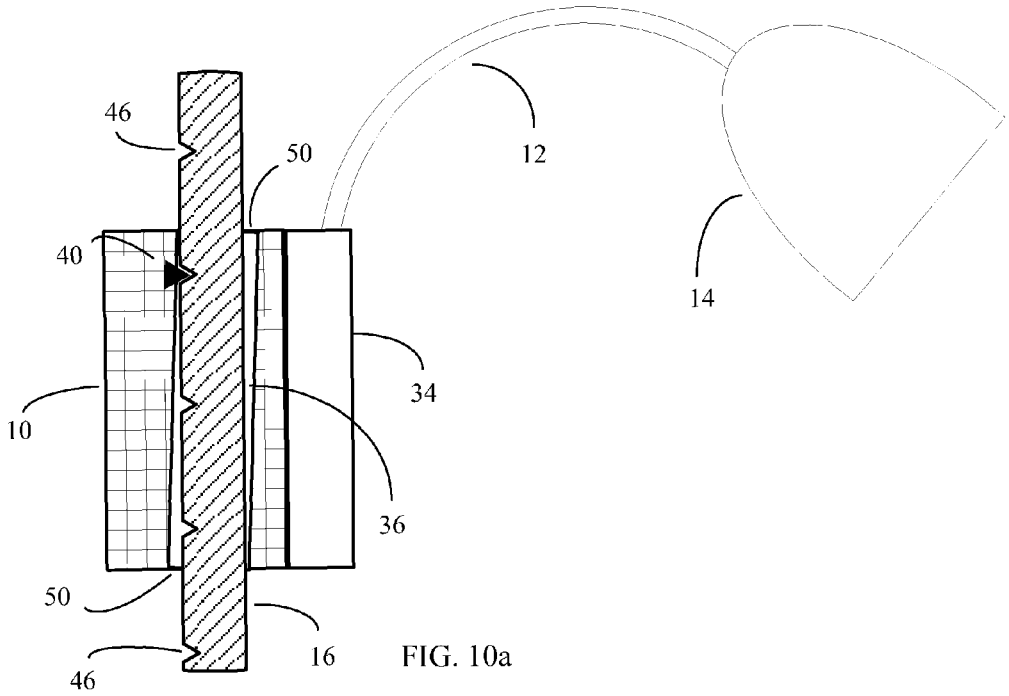

An alternative embodiment shown in FIG. 10*a* uses the same principle to keep base 10 from sliding along rods 16 except that the vertical holes 36 through base 10 are slightly canted so that, once the desired height has been reached, and pawl 40 is lodged into one of the notches 46 in rod 16, base 10 will be oriented substantially vertically, and will not appear to be tipped forward.

Figure 11:
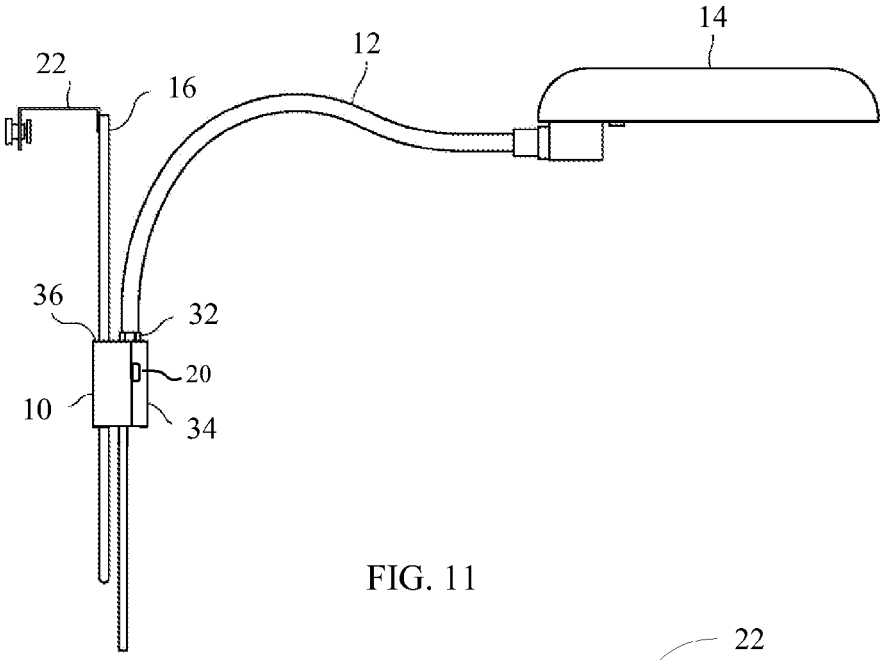
FIG. 11 is a side view of an embodiment of the lamp of this invention having a single lamp head.

FIGS. 11-14 depict an embodiment of the lamp of this invention having a single lamp head. In FIG. 11, base 10 is slidably attached to vertical rods 16 that extend through vertically oriented holes 36 through base 10. A single lamp head 14 is attached to base 10 by gooseneck 12. The point of attachment of gooseneck 12 to base 10 forms a hole 32 in the surface of base 10 through which wiring and attachments means for gooseneck 12 may be secured. A front section 34 on base 10 provides support for the attachment of gooseneck 12 and permits the use of a gooseneck whose diameter may be larger than could otherwise be supported by base 10. Bracket 22 operates in the same manner as the bracket for the dual lamp embodiment described earlier, and secures the lamp and frame to the upper edge of a cubicle wall. It will be understood by persons of ordinary skill in the art that any attachment means known in the art may be used to secure the lamp of this invention to a cubicle wall, and the invention is not limited to attachment only by means of bracket 22. It will be further understood that lamp head 14 shown in FIG. 11 is but one of many lamp heads known in the art, and the invention can be used with equal felicity with lamp heads of other styles and configurations.

Figure 12:
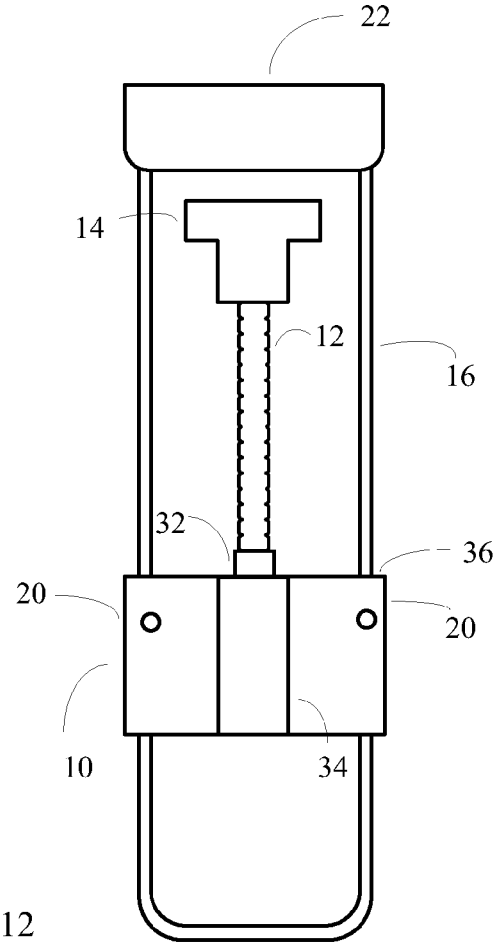
FIG. 12 is a front view of the lamp of FIG. 11.

FIG. 12 depicts the embodiment having a single lamp head, and further demonstrates the location of the component of the lamp of this invention. Base 10 is slidingly attached to rods 16, and may be secured by any methods previously described. In FIG. 12, tightening screws 20 are depicted. Gooseneck 12 attaches lamp head 14 to base 10, and allows the lamp head to be twisted and oriented in any desired direction.

Figure 13:
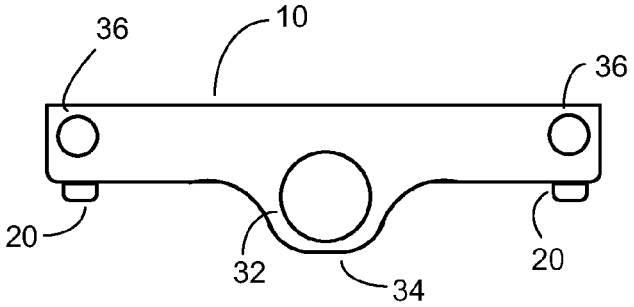
FIG. 13 is a plan view of the base of the lamp of FIG. 11.

FIG. 13 is a plan view of base 10, and shows an embodiment in which vertically oriented holes 36 are located near the outer edges of base 10. Front section 34 is an outward extension of base 10, and provides support by which a gooseneck may be affixed to base 10 through hole 32.

Figure 14:
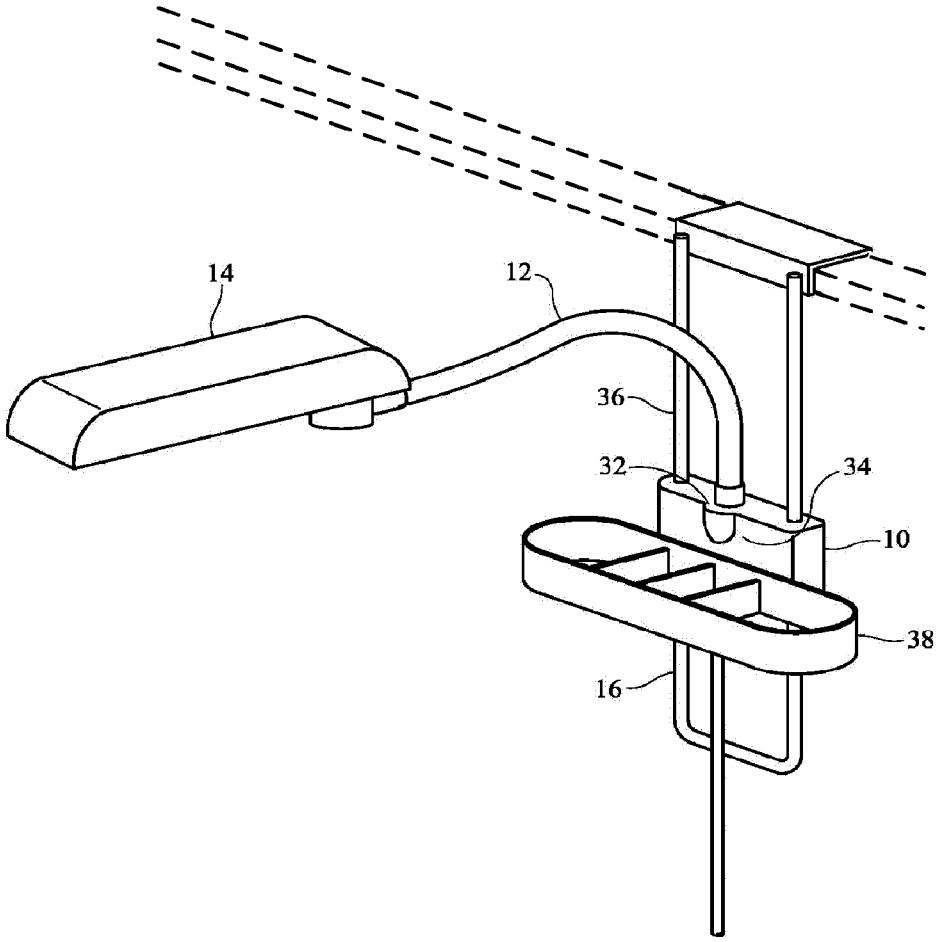
FIG. 14 is a perspective view of an embodiment of a lamp having an accessories tray and a single head.

FIG. 14 depicts an alternative embodiment of the lamp of this invention whereby base 10 may be configured to form an accessory holder 48. Alternatively, accessory holder 48 may be a separate component that is detachably attached to base 10, and may be used or not, depending upon personal preference or need.

Figure 15:
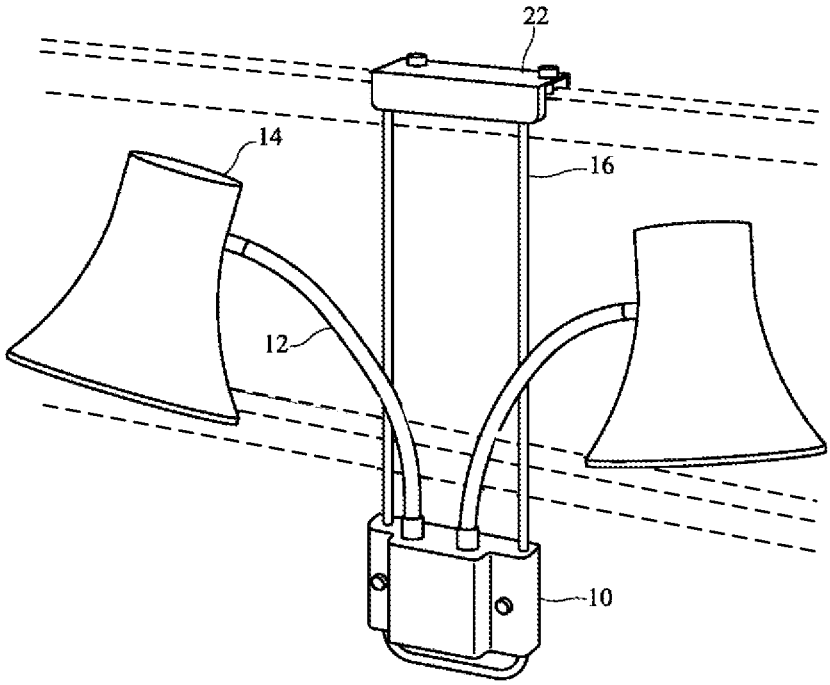
FIG. 15 is a perspective view of the lamp of this invention.

FIG. 15 is a perspective view of an embodiment of the lamp of this invention in which base 10 is at its lowermost extension from the top edge of the cubicle. Also shown in FIG. 15 are two tightening screws in mounting bracket 22, whereby a slidingly interactive two-piece bracket may be extended in width to accommodate unusually wide or unusually narrow cubicle walls.

Figure 16:
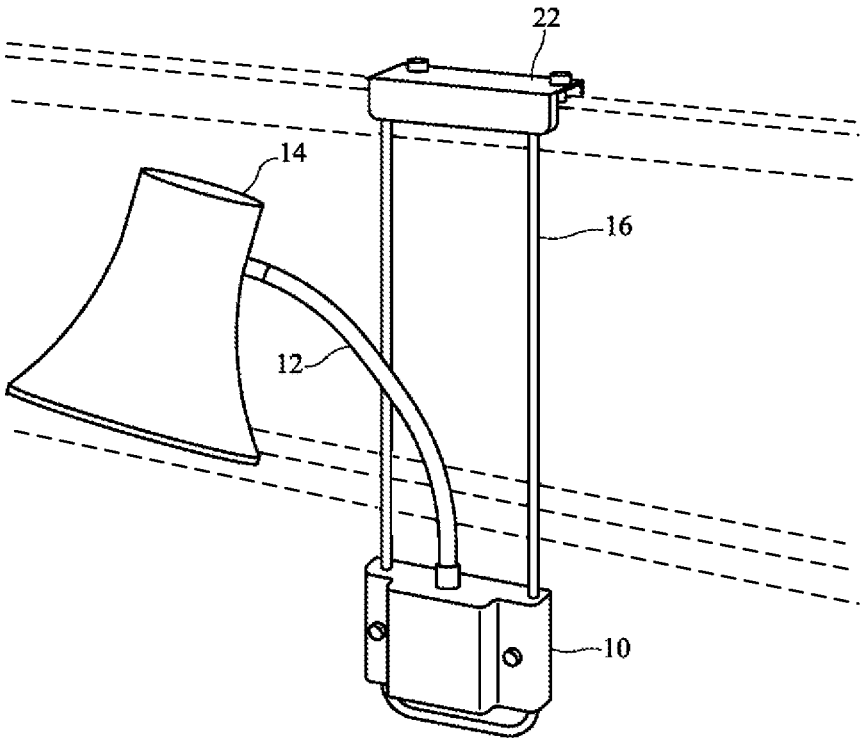
FIG. 16 is a perspective view of the lamp of this invention with a single head.

The single lamp head embodiment of FIG. 16 may tend to cause the vertical frame of this invention to tilt in response to the lamp head being fully extended to one side or the other. This condition may be prevented by tightening mounting bracket 22 such that it firmly grasps the upper edge of the cubicle wall and holds the frame rigid in an essentially vertical mounting.

Figure 17:
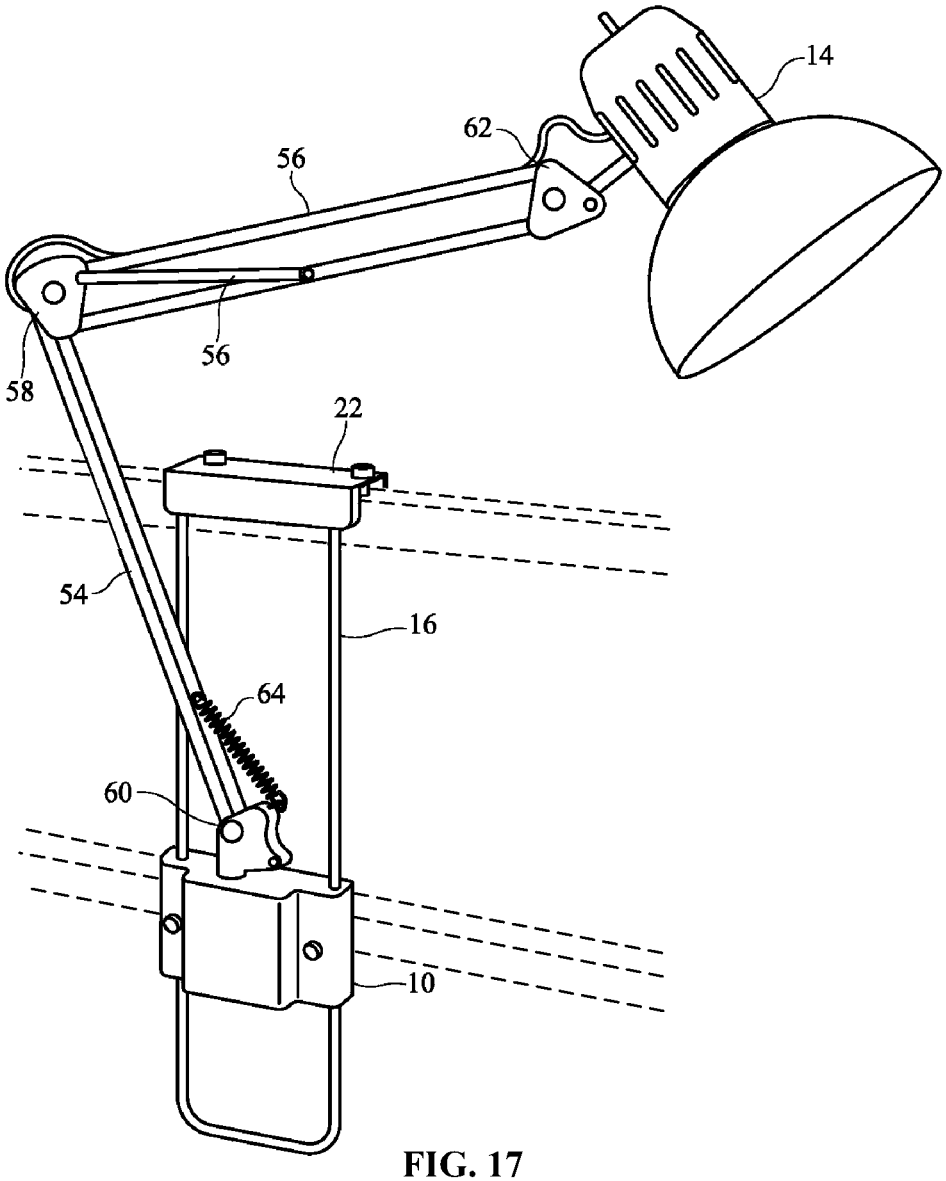
FIG. 17 is a perspective view of another embodiment of the lamp of this invention having an articulated neck.

In a similar manner, the tightening mounting bracket 22 will hold the frame 16 securely when larger or heavier lamp heads may be used with the frame. FIG. 17 is a perspective view of another embodiment of the invention in which the gooseneck has been replaced by an articulated arm 54, 56 connected at a swivel joint 58 and connected to the base 10 with swivel joint 60, and to the lamp head 14 at swivel joint 62. Spring 56 and damping piston 64 counteract the force of gravity to maintain the lamp head in a desired position while the other mechanisms of the invention described above hold the base 10 at any desired vertical position along the frame.

The foregoing description and drawings are exemplary of the invention, as to which persons of ordinary skill in the art may substitute other known components without departing from the spirit and scope of the invention.

I claim:

1. A vertically adjustable cubicle lamp comprising:

a frame, a base, and one or more gooseneck extenders, each gooseneck extender being attached to one or more lamp heads;

said frame comprising a plurality of rods being substantially vertically oriented, an upper bracket, and a lower joining member substantially horizontally oriented, said plurality of rods being attached at their upper ends to said upper bracket and being attached at their lower ends to said lower joining member, said upper bracket being configured to attach to an upper edge of a cubicle partition;

said base comprising a plurality of vertical through-holes wherein said plurality of said rods is received such that each rod extends through a through hole, said through holes in said base being larger than said rods, said base further comprising one or more lamp attachment cavities wherein said one or more gooseneck extenders and lamp heads are attached to said base, said base further comprising an internal cavity for holding wiring for said one or more lamp heads;

at least one of said rods further comprising one or more indentations on said at least one rod, said base further comprising a pawl, said pawl being rigidly attached to said base and being configured to engage one of said indentations on said at least one of said rods such that, when said base is tilted upward, said pawl is disengaged from said one of said indentations in said at least one of said rods, and when said base is not tilted upward, said pawl engages said one of said indentations in said at least one of said rods.

* * * * *